US008457342B2

(12) United States Patent
Tanaka et al.

(10) Patent No.: US 8,457,342 B2
(45) Date of Patent: Jun. 4, 2013

(54) DIFFERENTIAL MICROPHONE

(75) Inventors: Fuminori Tanaka, Daito (JP); Ryusuke Horibe, Daito (JP); Takeshi Inoda, Daito (JP); Rikuo Takano, Daito (JP); Kiyoshi Sugiyama, Mitaka (JP); Toshimi Fukuoka, Yokohama (JP); Masatoshi Ono, Tsukuba (JP)

(73) Assignees: Funai Electric Co., Ltd., Daito-shi (JP); Funai Electric Advanced Applied Technology Research Institute Inc., Daito-shi (JP)

( * ) Notice: Subject to any disclaimer, the term of this patent is extended or adjusted under 35 U.S.C. 154(b) by 96 days.

(21) Appl. No.: 13/056,498

(22) PCT Filed: Jul. 16, 2009

(86) PCT No.: PCT/JP2009/062903

§ 371 (c)(1),
(2), (4) Date: Jan. 28, 2011

(87) PCT Pub. No.: WO2010/013602

PCT Pub. Date: Feb. 4, 2010

(65) Prior Publication Data

US 2011/0176698 A1 Jul. 21, 2011

(30) Foreign Application Priority Data

Jul. 30, 2008 (JP) ..... 2008-196539

(51) Int. Cl.
*H04R 1/08* (2006.01)
*H04R 21/02* (2006.01)

(52) U.S. Cl.
CPC . *H04R 1/08* (2013.01); *H04R 21/02* (2013.01)
USPC ..... 381/357; 381/355; 381/361

(58) Field of Classification Search
USPC ..... 381/355–360, 361, 369; 379/388.02, 379/420.03, 433.03
See application file for complete search history.

(56) References Cited

U.S. PATENT DOCUMENTS

| | | | |
|---|---|---|---|
| 4,720,857 | A | 1/1988 | Burris et al. |
| 5,121,426 | A | 6/1992 | Baumhauer, Jr. et al. |
| 2003/0002701 | A1 | 1/2003 | Niederdrank |
| 2007/0041597 | A1 | 2/2007 | Song |

(Continued)

FOREIGN PATENT DOCUMENTS

| | | |
|---|---|---|
| EP | 1 272 002 A2 | 1/2003 |
| EP | 1 397 023 A2 | 3/2004 |

(Continued)

OTHER PUBLICATIONS

International Search Report dated Oct. 13, 2009 (One (1) page).

(Continued)

*Primary Examiner* — Tuan D Nguyen
(74) *Attorney, Agent, or Firm* — Crowell & Moring LLP

(57) ABSTRACT

A differential microphone includes a housing having a first space and a second space formed therein, and a first diaphragm arranged within the housing. A first opening connecting the first space to outside and a second opening connecting the second space to the outside are formed in the housing. A dimension of the first opening and the second opening in a first direction perpendicular to a straight line passing through centers of both openings is longer than a dimension of the first opening and the second opening in a second direction parallel to the straight line passing through the centers of both openings.

8 Claims, 10 Drawing Sheets

U.S. PATENT DOCUMENTS

| | | | |
|---|---|---|---|
| 2007/0165898 | A1 | 7/2007 | Huang et al. |
| 2010/0266146 | A1 | 10/2010 | Takano et al. |
| 2010/0280825 | A1 | 11/2010 | Takano et al. |

FOREIGN PATENT DOCUMENTS

| | | | |
|---|---|---|---|
| EP | 1 643 798 | A1 | 4/2006 |
| EP | 2 094 027 | A1 | 8/2009 |
| JP | 3-293846 | A | 12/1991 |
| JP | 6-284494 | | 10/1994 |
| JP | 7-61098 | B2 | 6/1995 |
| JP | 7-95777 | B2 | 10/1995 |
| JP | 2001-268695 | A | 9/2001 |
| JP | 2005-295278 | A | 10/2005 |
| JP | 2007-60661 | A | 3/2007 |
| JP | 2007-81614 | A | 3/2007 |
| JP | 2007-104556 | A | 4/2007 |
| JP | 2007-195140 | A | 8/2007 |
| JP | 2007-201976 | A | 8/2007 |
| JP | 2008-99271 | A | 4/2008 |
| JP | 2008-131474 | A | 6/2008 |
| JP | 2008-154224 | | 7/2008 |

OTHER PUBLICATIONS

European Search Report dated Feb. 15, 2013 in related application No. 09802845.9.

Chinese-language Office Action dated Apr. 3, 2013 (six (6) pages).

a)SHAPE OF SOUND HOLE (CIRCULAR)

b)SHAPE OF SOUND HOLE (OVAL)

DIFFERENTIAL MICROPHONE

TECHNICAL FIELD

The present invention relates to a differential microphone, and particularly, to a differential microphone including at least two openings in a housing that houses a diaphragm.

BACKGROUND ART

A differential microphone that can receive a sound from outside and reduce noise included in the sound has been known. A mobile phone utilizing such differential microphone can obtain a sound signal having little noise, that is, such a sound signal that a person at the other end can readily listen to sounds produced by a speaker.

In order to cancel out vibration of noise transmitted to a diaphragm or to cancel out a signal of noise output from the diaphragm, the differential microphone has at least two openings through which sounds are input. As will be described in the following, techniques for efficiently reducing noise have been proposed for the differential microphone.

Japanese Patent Laying-Open No. 2007-195140 (Patent Document 1), for example, discloses a unit structure of a microphone that prevents foreign substances from entering the microphone. According to Japanese Patent Laying-Open No. 2007-195140 (Patent Document 1), the microphone includes a substrate having a circuit board, a sound-processing unit connected to the circuit board, an upper lid connected to the substrate, and a sound hole provided in a lateral side of the upper lid.

In addition, Japanese Patent Laying-Open No. 2001-268695 (Patent Document 2) discloses an electret capacitor microphone. According to Japanese Patent Laying-Open No. 2001-268695 (Patent Document 2), the electret capacitor microphone includes a ceramic package which holds a back electrode having an electret dielectric film stuck on its top surface or a diaphragm ring made of a metal material having a diaphragm film stuck, by mounting it on an upper-end surface. A metal material film constituting an input terminal surface is formed on an upper-end surface of a peripheral side wall of the ceramic package and an input conduction film is formed by extending the input conduction film from the input terminal surface to an internal surface of the peripheral side wall and a top surface of a bottom part. An IC bare chip including an impedance converting circuit is fitted to the bottom part of the ceramic package and the input conduction film is electrically connected to an input end of the IC bare chip. The electret capacitor microphone includes a capsule made of a metallic cylinder. The ceramic package is put in the capsule.

In addition, Japanese Patent Laying-Open No. 2007-201976 (Patent Document 3) discloses a directional acoustic device. According to Japanese Patent Laying-Open No. 2007-201976 (Patent Document 3), a microphone includes a housing in a hollow box shape, a diaphragm housed within the housing, and a plurality of sound paths connecting a space in front of the diaphragm within the housing to the outside of the housing. In such a microphone, porous materials are disposed in the respective sound paths so as to make acoustic resistances of the respective sound paths different from one another, so that acoustics passing through the respective sound paths reach the diaphragm simultaneously when the acoustics are simultaneously made incident from outside the housing to all of the sound paths.

In addition, Japanese National Patent Publication No. 07-95777 (Patent Document 4) discloses a two-way sound communication headphone. According to Japanese National Patent Publication No. 07-95777 (Patent Document 4), the headphone includes a housing, means connected to the housing and including a microphone for converting wearer's conversation to an electric signal, means connected to the housing and including a receiver for converting the received electric signal to a sound, and means including an earpiece assembly supported by the housing, for conveying the sound from the means for converting the received signal to a wearer's ear.

In addition, Japanese Patent Laying-Open No. 2007-60661 (Patent Document 5) discloses a silicon based capacitor microphone. According to Japanese Patent Laying-Open No. 2007-60661 (Patent Document 5), the silicon based capacitor microphone includes a metal case, and a substrate which is mounted with an MEMS (Micro Electro Mechanical System) microphone chip and an ASIC (Application Specific Integrated Circuit) chip having a voltage pump and a buffer IC and is formed with a connecting pattern, on its surface, for bonding with the metal case, the connecting pattern being bonded to the metal case.

PRIOR ART DOCUMENTS

Patent Documents

Patent Document 1: Japanese Patent Laying-Open No. 2007-195140

Patent Document 2: Japanese Patent Laying-Open No. 2001-268695

Patent Document 3: Japanese Patent Laying-Open No. 2007-201976

Patent Document 4: Japanese National Patent Publication No. 07-95777

Patent Document 5: Japanese Patent Laying-Open No. 2007-60661

SUMMARY OF THE INVENTION

Problems to be Solved by the Invention

In conventional differential microphones, however, a sound source area where produced sounds cannot be sensed occurs because of the positional relationship and the like between the openings. For example, some bidirectional differential microphones can sufficiently sense sounds produced from a sound source located on a straight line passing through the centers of the respective openings and cannot sense sounds produced from a sound source located on a straight line that is perpendicular to the straight line and passes through a midpoint between both openings.

The present invention has been made to overcome the above defect, and a main object of the present invention is to provide a differential microphone having a small area where the differential microphone cannot sense sounds produced therein.

Means for Solving the Problems

In order to solve the above problems, according to an aspect of the present invention, a differential microphone is provided. The differential microphone includes a housing having a first space and a second space formed therein, and a first diaphragm arranged within the housing. A first opening connecting the first space to outside and a second opening connecting the second space to the outside are formed in the housing. A dimension of the first opening and the second opening in a first direction perpendicular to a straight line passing through centers of both openings is longer than a dimension of the first opening and the second opening in a second direction parallel to the straight line passing through the centers of both openings.

Preferably, the first diaphragm separates a space within the housing into the first space and the second space.

Preferably, a distance from the center of the first opening to the first diaphragm is equal to a distance from the center of the second opening to the first diaphragm.

Preferably, the first diaphragm is arranged within the first space. The differential microphone further includes a second diaphragm arranged within the second space.

Preferably, a distance from the center of the first opening to the first diaphragm is equal to a distance from the center of the second opening to the second diaphragm.

Preferably, the first opening and the second opening are formed in an identical surface of the housing.

Preferably, the first opening and the second opening have an oval shape whose longer axis corresponds to the first direction.

Preferably, the first opening and the second opening have an identical shape.

Effects of the Invention

As described above, according to the present invention, there can be provided a differential microphone having a small area where the differential microphone cannot sense sounds produced therein.

MODES FOR CARRYING OUT THE INVENTION

Figure 1:
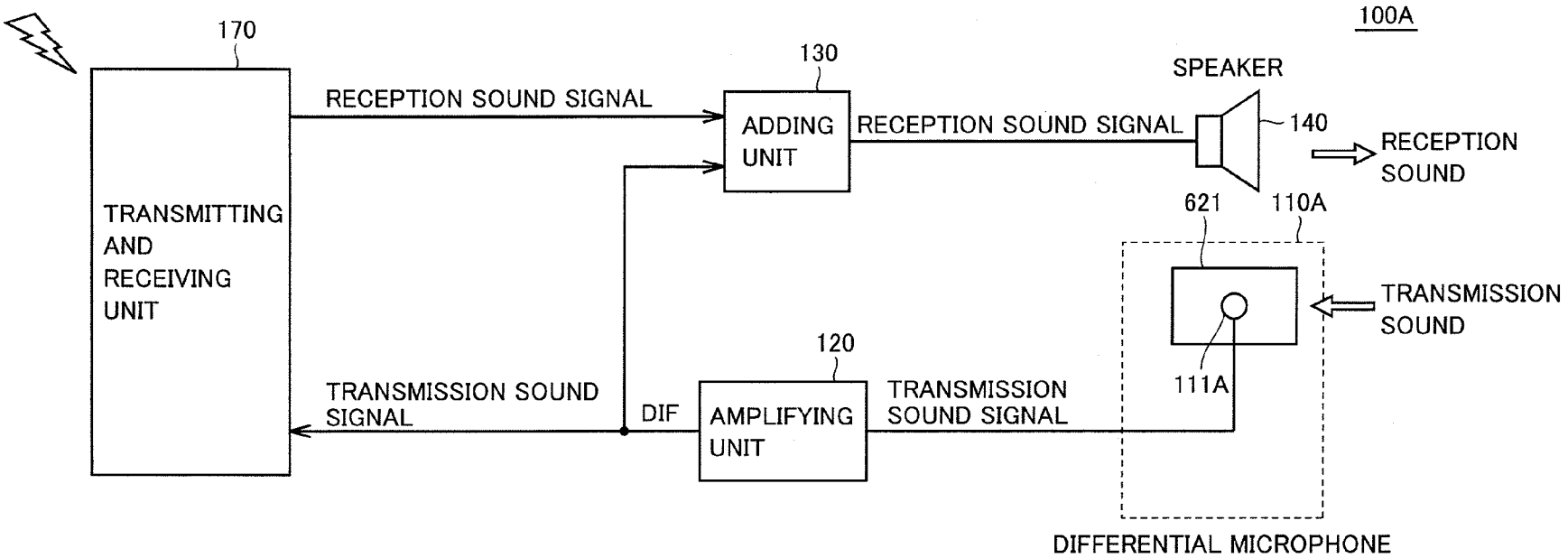
FIG. 1 is a block diagram showing an overall configuration of a sound signal transmitting and receiving device according to a first embodiment.

Embodiments of the present invention will be described hereinafter with reference to the drawings. In the following description, the same components are denoted with the same reference characters. Their names and functions are also the same. Accordingly, detailed description on them will not be repeated.

First Embodiment

<Overall Configuration of Sound Signal Transmitting and Receiving Device 100A>

FIG. 1 is a block diagram showing an overall configuration of a sound signal transmitting and receiving device 100A according to the present embodiment. Sound signal transmitting and receiving device 100A according to the present embodiment is, for example, a mobile phone. As shown in FIG. 1, sound signal transmitting and receiving device 100A includes a differential microphone 110A, an amplifying unit 120, an adding unit 130, a speaker 140, and a transmitting and receiving unit 170. Each block forming sound signal transmitting and receiving device 100A according to the present embodiment is implemented by, for example, a dedicated hardware circuit and the like such as a gain adjusting device, an adder and a radio communication device.

Sound signal transmitting and receiving device 100A may, however, be a mobile phone or a personal computer having a CPU (Central Processing Unit) and a memory device, and each block may be implemented as a part of the functions of the CPU. In other words, sound signal transmitting and receiving device 100A may have such a configuration that the CPU reads a control program for implementing the following functions from the memory device having the control program stored therein and executes the control program, thereby implementing the function of each block.

In FIG. 1, amplifying unit 120 is implemented by an amplifier circuit and the like including an operational amplifier and the like, and is connected to differential microphone 110A, adding unit 130, and transmitting and receiving unit 170. Amplifying unit 120 amplifies a transmission sound signal input from differential microphone 110A, and outputs the transmission sound signal to transmitting and receiving unit 170 and adding unit 130.

Transmitting and receiving unit 170 is implemented by a radio communication device such as a not-shown antenna, and is connected to amplifying unit 120 and adding unit 130. Transmitting and receiving unit 170 receives a reception sound signal, and in addition, transmits a transmission sound signal. More specifically, transmitting and receiving unit 170 transmits to the outside the transmission sound signal input from amplifying unit 120, and receives the reception sound signal from outside and outputs the reception sound signal to adding unit 130.

Adding unit 130 is connected to transmitting and receiving unit 170, amplifying unit 120 and speaker 140. Adding unit 130 adds the reception sound signal input from transmitting and receiving unit 170 and the transmission sound signal input from amplifying unit 120 to generate an addition signal, and outputs the addition signal to speaker 140.

Speaker 140 converts the addition signal input from adding unit 130 into a reception sound and outputs the reception sound.

<Configuration of Vibration Sensing Unit 111A>

Figure 2:
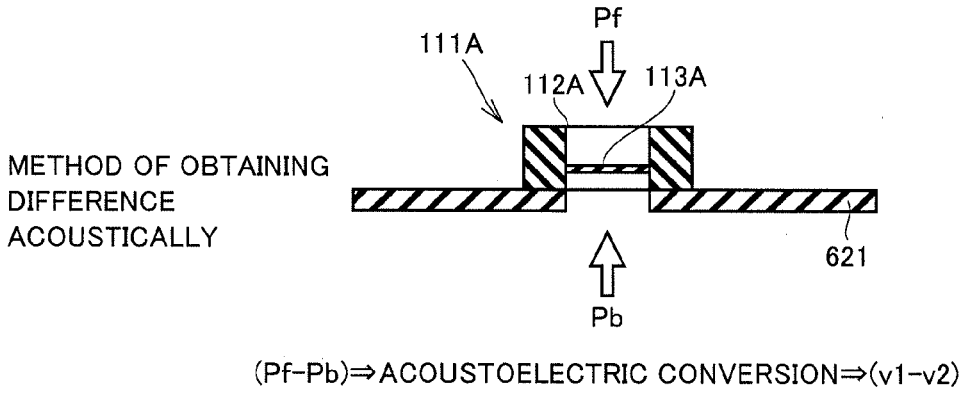
FIG. 2 is a front cross-sectional view showing a vibration sensing unit.

Differential microphone 110A according to the present embodiment will be described hereinafter. As shown in FIG. 1, differential microphone 110A according to the present embodiment is typically used in a sound signal transmitting and receiving device 100 and the like. Differential microphone 110A according to the present embodiment may, however, be used as merely a microphone. FIG. 2 is a front cross-sectional view showing a vibration sensing unit 111A.

As shown in FIGS. 1 and 2, differential microphone 110A according to the present embodiment includes one vibration sensing unit 111A. As will be described later, differential microphone 110A according to the present embodiment removes background noise by obtaining an acoustic difference.

Vibration sensing unit 111A includes a diaphragm 113A and an ASIC (Application Specific Integrated Circuit) that will be described later. Vibration sensing unit 111A vibrates in accordance with sound pressures (amplitudes of sound waves) Pf and Pb reaching diaphragm 113A from two directions, and generates an electric signal corresponding to this vibration. In other words, differential microphone 110A receives a transmission sound transmitted from the two directions, and converts the transmission sound to the electric signal.

In differential microphone 110A according to the present embodiment, diaphragm 113A is configured to receive sound pressures Pf and Pb from both the upper side and the lower side, and diaphragm 113A vibrates in accordance with a sound pressure difference (Pf-Pb). Therefore, when sound pressures of the same magnitude are simultaneously applied to both sides of diaphragm 113A, these two sound pressures cancel each other out at diaphragm 113A and diaphragm 113A does not vibrate. In contrast, when there is a difference in sound pressures applied to both sides, diaphragm 113A vibrates in accordance with this sound pressure difference.

<Principle of Noise Removal in Differential Microphone>

Figure 3:
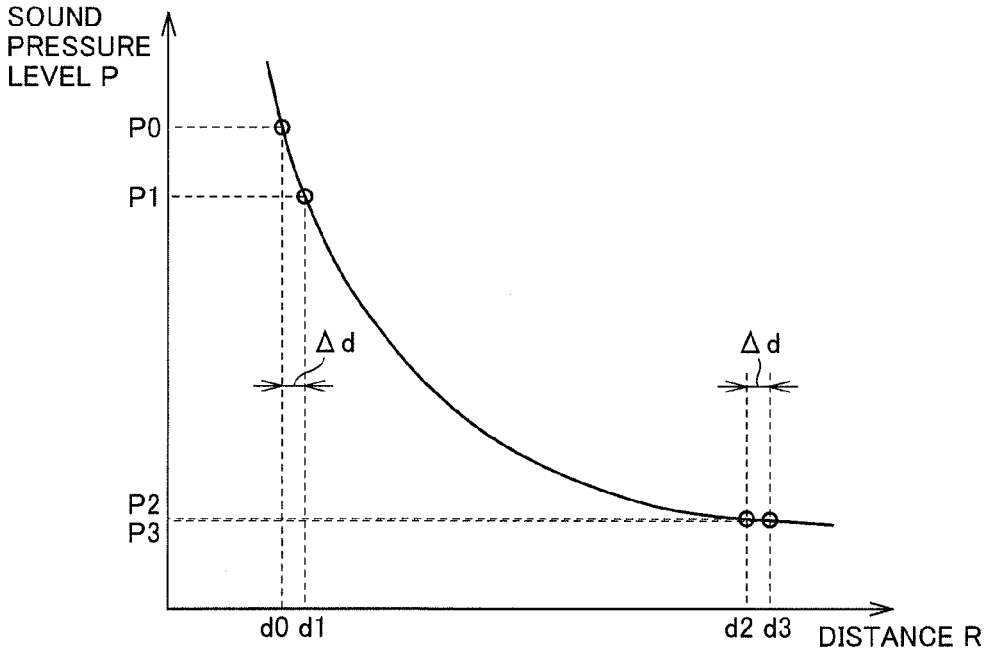
FIG. 3 is a graph showing the relationship between a sound pressure P and a distance R from a sound source.

Next, a principle of noise removal in the differential microphone will be described. FIG. 3 is a graph showing the relationship between a sound pressure P and a distance R from a sound source. As shown in FIG. 3, a sound wave attenuates as the sound wave travels through a medium such as air, and the sound pressure (intensity and amplitude of the sound wave) decreases. Since the sound pressure is inversely proportional to the distance from the sound source, sound pressure P can be expressed as follows in the relationship with distance R from the sound source:

$$P=k/R \tag{1}$$

It is noted that in expression (1), k refers to a proportionality constant.

As is also clear from FIG. 3 and expression (1), the sound pressure (amplitude of the sound wave) attenuates sharply at a position close to the sound source (on the left side in the graph), and attenuates gently as the distance from the sound source increases. In other words, the sound pressure transmitted to two positions (d0 and d1, d2 and d3), between which there is a difference of only Δd in distance from the sound source, attenuates greatly (P0-P1) between d0 and d1 where the distance from the sound source is small, and does not attenuate greatly (P2-P3) between d2 and d3 where the distance from the sound source is large.

When differential microphone 110A according to the present embodiment is applied to sound signal transmitting and receiving device 100A typified by a mobile phone, a speech sound from a speaker occurs near differential microphone 110A. Therefore, the sound pressure of the speech sound from the speaker attenuates greatly between sound pressure Pf reaching an upper surface of diaphragm 113A and sound pressure Pb reaching a lower surface of diaphragm 113A. In other words, as for the speech sound from the speaker, there is a large difference between sound pressure Pf reaching the upper surface of diaphragm 113A and sound pressure Pb reaching the lower surface of diaphragm 113A.

In contrast to this, the sound source of the background noise is located farther from differential microphone 110A as compared with the speech sound from the speaker. Therefore, the sound pressure of the background noise hardly attenuates between Pf reaching the upper surface of diaphragm 113A and sound pressure Pb reaching the lower surface of diaphragm 113A. In other words, as for the background noise, there is a small difference between sound pressure Pf reaching the upper surface of diaphragm 113A and sound pressure Pb reaching the lower surface of diaphragm 113A.

Figure 4:
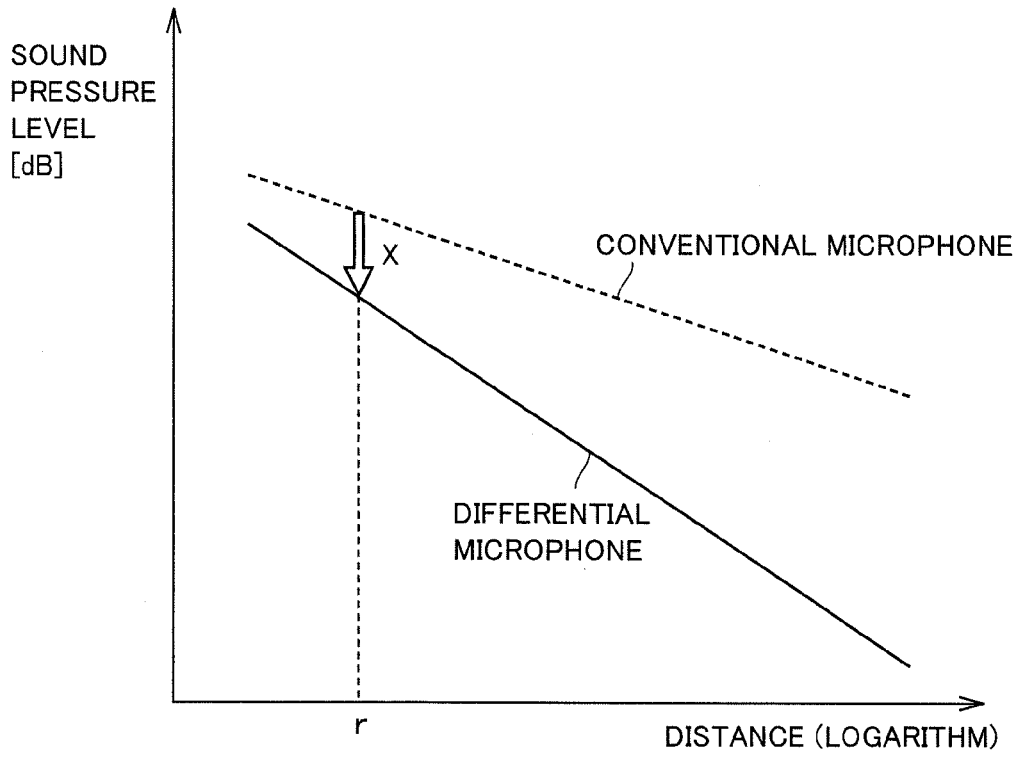
FIG. 4 is a graph showing the relationship between a logarithm of distance R from the sound source and a logarithm of sound pressure P output by a microphone.

FIG. 4 is a graph showing the relationship between a logarithm of distance R from the sound source and a logarithm of sound pressure P (dB: decibel) output by the microphone. A characteristic of a conventional microphone unit is indicated with a dotted line and a characteristic of differential microphone 110A according to the present embodiment is indicated with a solid line.

As shown in FIG. 4, the sound pressure level (dB) detected and output by differential microphone 110A according to the present embodiment exhibits a characteristic that the sound pressure level decreases more greatly as compared with the conventional microphone as the distance from the sound source increases. In other words, the sound pressure level decreases more remarkably in differential microphone 110A according to the present embodiment than in the conventional microphone as the distance from the sound source increases.

Referring to FIGS. 2 to 4, since the sound pressure difference (Pf-Pb) of the background noise received at diaphragm 113A is very small, a noise signal indicating the background noise generated by differential microphone 110A becomes very small. In contrast to this, since the sound pressure difference (Pf-Pb) of the speech sound from the speaker received at diaphragm 113A is large, a speech signal indicating the speech sound generated at differential microphone 110A becomes large. In other words, differential microphone 110A can mainly output the speech signal indicating the speech sound.

<Configuration of Differential Microphone 110A>

Figure 5A:
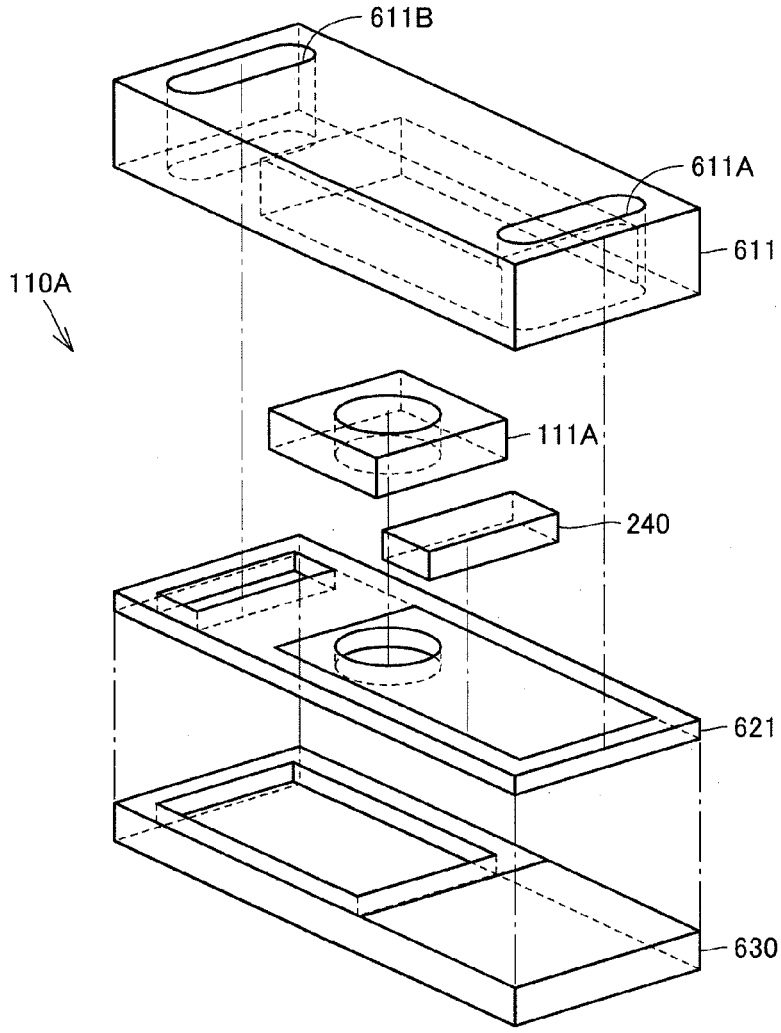
FIG. 5A is a perspective view showing an assembly configuration of a differential microphone according to the present embodiment.
Figure 5B:
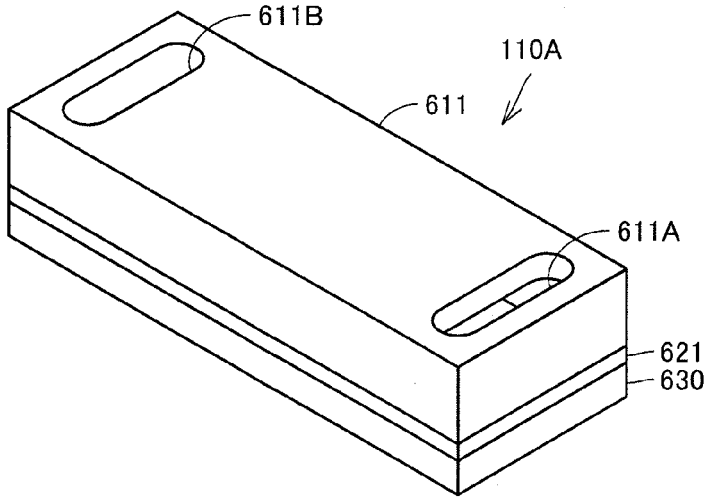
FIG. 5B is an outer perspective view of the differential microphone according to the present embodiment.
Figure 6:
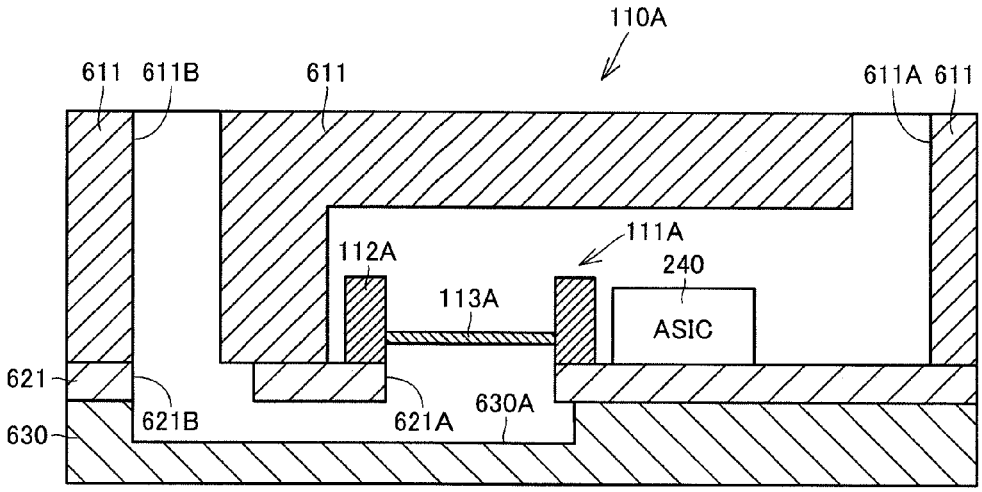
FIG. 6 is a front cross-sectional view of the differential microphone according to the first embodiment.

Next, a configuration of differential microphone 110A according to the present embodiment will be described. FIG. 5A is a perspective view showing an assembly configuration of differential microphone 110A according to the present embodiment, and FIG. 5B is an outer perspective view of differential microphone 110A according to the present embodiment. FIG. 6 is a front cross-sectional view of differential microphone 110 according to the present embodiment.

As shown in FIGS. 5A, 5B and 6, differential microphone 110A includes a first substrate 630, a second substrate 621 stacked on first substrate 630, and an upper housing 611 stacked on second substrate 621. A thin bottom portion 630A is formed at first substrate 630.

Diaphragm 113A and an ASIC (signal processing circuit) 240 are arranged on an upper surface of second substrate 621. ASIC 240 performs processing such as amplification and the like of a signal based on vibration of diaphragm 113A. ASIC 240 is preferably arranged close to diaphragm 113A. When a signal based on vibration of diaphragm 113A is weak, an influence of external electromagnetic noise can be minimized and the SNR (Signal to Noise Ratio) can be enhanced. In addition, ASIC 240 may be configured to incorporate not only an amplification circuit but also an AD converter and the like and to allow digital output.

A first substrate opening 621A is formed in second substrate 621 above thin bottom portion 630A and below diaphragm 113A. In addition, a second substrate opening 621B is formed in second substrate 621 above thin bottom portion 630A.

A first space for surrounding (housing) diaphragm 113A and ASIC 240 is formed between upper housing 611 and second substrate 621. A first opening 611A for transmitting the sound vibration from outside differential microphone 110A to the first space is formed at one end of upper housing 611. The sound vibration travels through first opening 611A and the first space to the upper surface of diaphragm 113A.

In addition, a second opening 611B for transmitting the sound vibration from outside differential microphone 110A to the lower surface of diaphragm 113A is formed at the other end of upper housing 611. Second opening 611B, second substrate opening 621B, a space surrounded by thin bottom portion 630A, and first substrate opening 621A form a second space.

Since differential microphone 110A according to the present embodiment is configured as described above, the sound wave transmitted to the upper surface of diaphragm 113A and the sound wave traveling through and along second substrate 621 to the lower surface of diaphragm 113A, of the sound wave from the sound source located on a straight line connecting first opening 611A and second opening 611B, are different from each other in terms of a transmission distance from the sound source to diaphragm 113A. In other words, the sound wave (sound pressure Pf) transmitted through first opening 611A to the upper surface of diaphragm 113A and the sound wave (sound pressure Pb) transmitted through second opening 611B to the lower surface of diaphragm 113A, of the sound wave propagated from the position on the straight line connecting first opening 611A and second opening 611B, are different from each other in terms of the transmission distance from the sound source to diaphragm 113A.

In addition, differential microphone 110A may be configured such that a sound wave arrival time from first opening 611A to diaphragm 113A is equal to a sound wave arrival time from second opening 611B to diaphragm 113A. In order to make the sound wave arrival times equal, differential microphone 110A may be configured, for example, such that a path length of the sound wave from first opening 611A to diaphragm 113A is equal to a path length of the sound wave from second opening 611B to diaphragm 113A. The path length may be, for example, a length of a line connecting a center in a cross section of the path. Preferably, by making the ratio of the path lengths equal in the range of ±20% (80% or more and 120% or less) and making acoustic impedances substantially equal, excellent characteristics of the differential microphone can be obtained especially in the high-frequency band.

With this configuration, the arrival time of the sound wave traveling from first opening 611A to diaphragm 113A and the arrival time of the sound wave traveling from second opening 611B to diaphragm 113A, that is, the phase can be made equal, and thus, the noise removal function of higher accuracy can be achieved.

As described above, the sound pressure attenuates sharply at the position close to the sound source (on the left side in the graph in FIG. 4), and attenuates gently at the position farther from the sound source (on the right side in the graph in FIG. 4).

Therefore, as for the sound wave of the speech sound from the speaker, sound pressure Pf transmitted to the upper surface of diaphragm 113A differs significantly from sound pressure Pb transmitted to the lower surface of diaphragm 113A. On the other hand, as for the sound wave of the surrounding background noise, a difference between sound pressure Pf transmitted to the upper surface of diaphragm 113A and sound pressure Pb transmitted to the lower surface of diaphragm 113A is very small.

Since there is only a very small difference between sound pressures Pf and Pb of the background noise received at diaphragm 113A, the sound pressures of the background noise substantially cancel each other out at diaphragm 113A. In contrast to this, since there is a large difference between sound pressures Pf and Pb of the speech sound from the speaker received at diaphragm 113A, the sound pressures of the speech sound do not cancel each other out at diaphragm 113A. In such a manner, differential microphone 110A uses ASIC 240 to output, as the transmission sound signal, a sound signal obtained as a result of vibration of diaphragm 113A.

As shown in FIGS. 5A and 5B, first opening 611A and second opening 611B according to the present embodiment do not have a simple circular shape. In other words, a dimension of first opening 611A and second opening 611B in a direction (first direction) perpendicular to a direction of a straight line passing through the centers of first opening 611A and second opening 611B is longer than a dimension in the direction (second direction) of the straight line passing through the centers of first opening 611A and second opening 611B.

As shown in FIGS. 5A and 5B, first opening 611A and second opening 611B according to the present embodiment have a shape of a track (a lane for track and field) in plan view.

Figure 7:
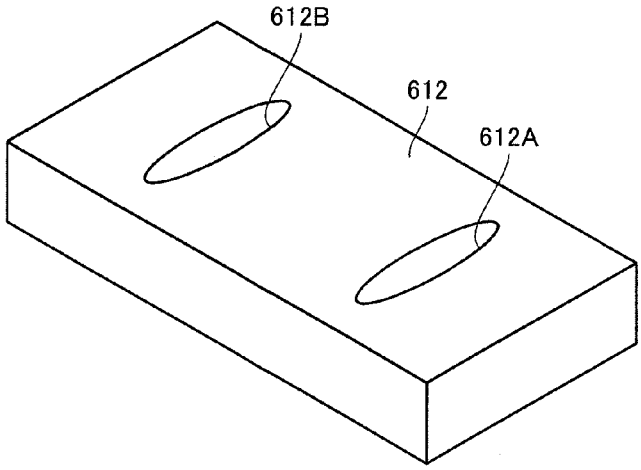
FIG. 7 is a perspective view showing a first modification of the shape of a first opening and a second opening.

FIG. 7 is a perspective view showing a first modification of the shape of a first opening 612A and a second opening 612B. As shown in FIG. 7, first opening 612A and second opening 612B of an upper housing 612 according to the first modification may have an oval shape in plan view whose longer axis matches a direction (first direction) perpendicular to a direction of a straight line passing through the centers of first opening 612A and second opening 612B.

Figure 8:
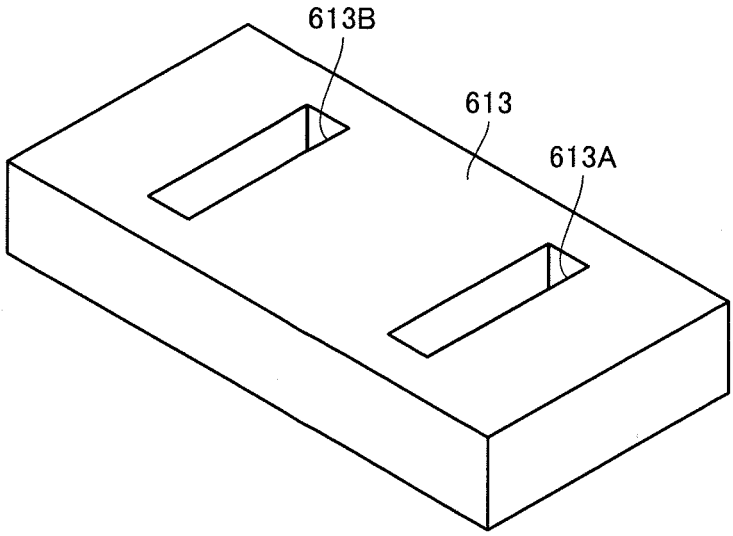
FIG. 8 is a perspective view showing a second modification of the shape of the first opening and the second opening.

FIG. 8 is a perspective view showing a second modification of the shape of a first opening 613A and a second opening 613B. As shown in FIG. 8, first opening 613A and second opening 613B of an upper housing 613 according to the first modification may have a rectangular shape whose longer side matches a direction (first direction) perpendicular to a direction of a straight line passing through the centers of first opening 613A and second opening 613B, that is, a rectangular shape in plan view.

Figure 9:
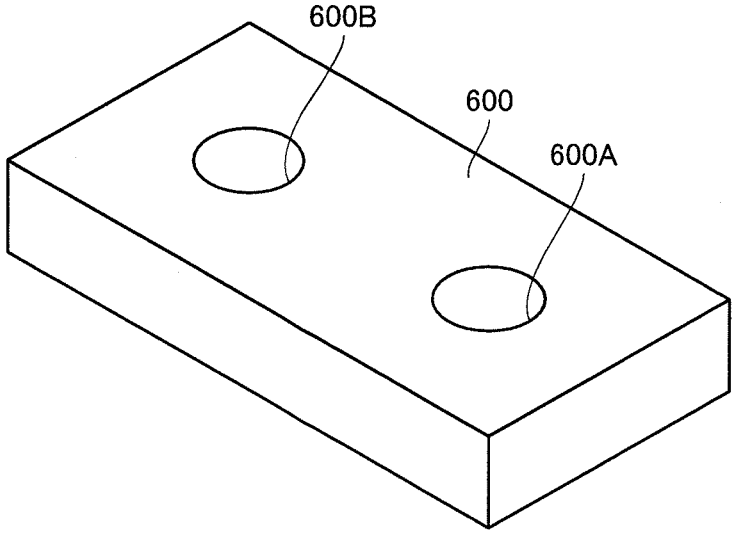
FIG. 9 is a perspective view showing the shape of a first opening and a second opening in an upper housing of a conventional differential microphone.

FIG. 9 is a perspective view showing the shape of a first opening 600A and a second opening 600B in an upper housing 600 of the conventional differential microphone. As shown in FIG. 9, in upper housing 600 of the conventional differential microphone, both first opening 600A and second opening 600B have a circular shape.

Figure 10:
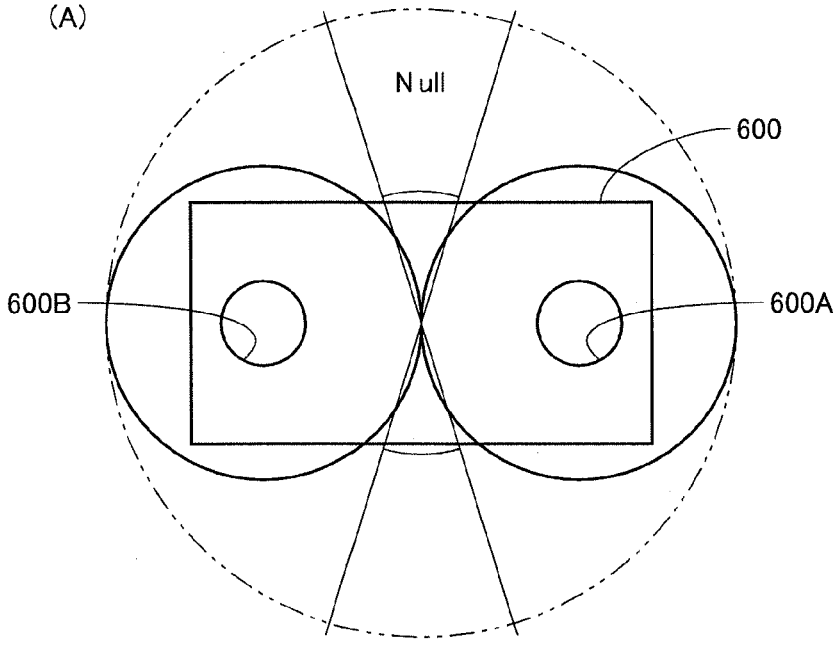
FIG. 10 is an image diagram showing a directional characteristic of the conventional differential microphone and an image diagram showing a directional characteristic of the differential microphone according to the present embodiment.
Figure 10:
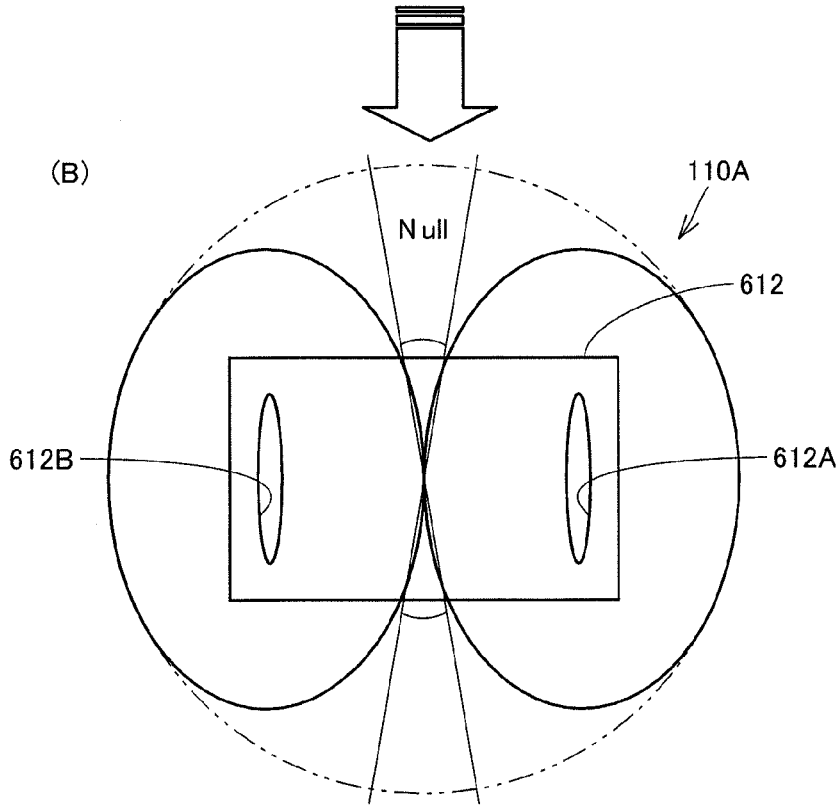

FIG. 10 is an image diagram showing a directional characteristic of the conventional differential microphone (configuration (A)) and an image diagram showing a directional characteristic of differential microphone 110A according to the present embodiment (configuration (B)).

As shown in FIGS. 2 and 6, in a differential microphone exhibiting a primary gradient, that is, a so-called close-talking microphone, the sound vibration is input from the front side and the rear side of diaphragm 113A. At this time, the conventional differential microphone exhibits a directional characteristic in a shape of "8" in plan view as shown in configuration (A) in FIG. 10. In other words, the conventional differential microphone has the highest sensitivity in a direction of a straight line connecting the respective centers (centers of gravity) of two openings 600A and 600B, and has low (no) sensitivity in a direction perpendicular to the direction of the straight line.

In the directional characteristic, a direction in which the differential microphone has no sensitivity to sounds is referred to as Null. In order to collect sounds over a range as wide as possible using the differential microphone, a smaller Null angle is preferable. Here, the Null angle is defined as the angular range where the sound pressure level is set to −20 dB or less with respect to the maximum sensitivity level in the directional characteristic.

As shown in configuration (B) in FIG. 10, in differential microphone 110A according to the present embodiment, the dimension of each of two openings 612A and 612B in the direction perpendicular to the straight line connecting the centers of both openings 612A and 612B is shorter than the dimension in a direction parallel to the straight line connecting the centers of both openings 612A and 612B. As a result, the Null angle in the directional characteristic can be decreased, and thus, differential microphone 110A according to the present embodiment can obtain sounds over a wide range while maintaining the noise suppression effect.

In differential microphone 110A where the dimension in the direction perpendicular to the straight line connecting the centers of the respective openings is longer than the dimension in the direction parallel to the straight line connecting the centers of both openings, the Null angle in the directional characteristic becomes small. Therefore, the respective openings may have a track shape, an oval shape or a rectangular shape.

Figure 11:
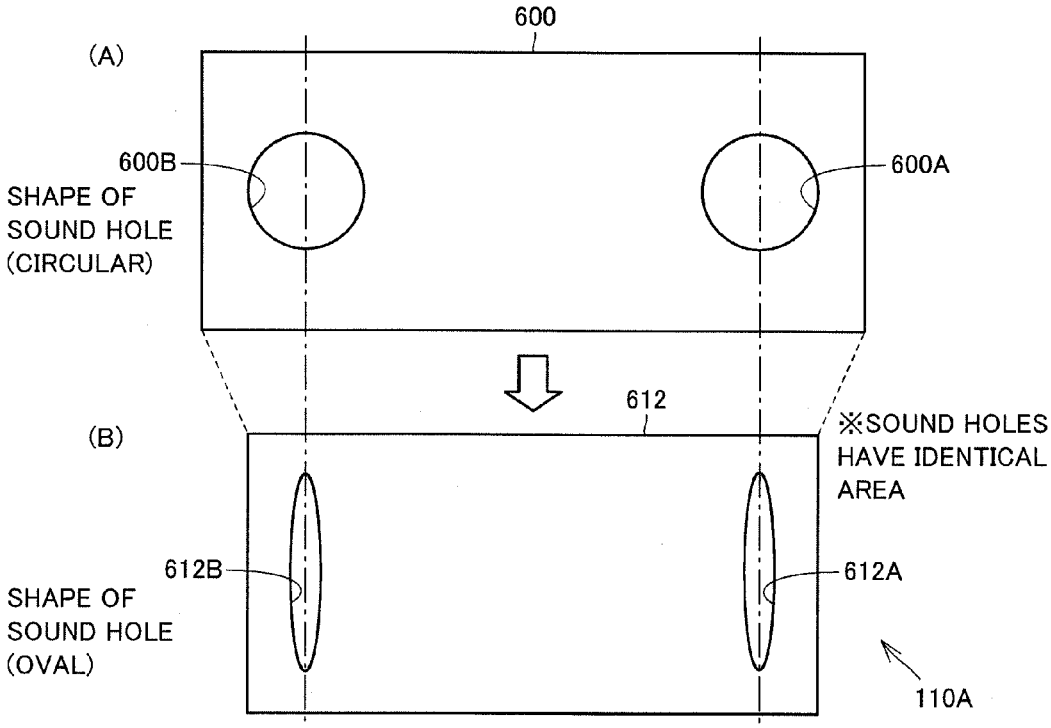
FIG. 11 is a plan view of the conventional differential microphone and a plan view of the differential microphone according to the present embodiment.

FIG. 11 is a plan view of the conventional differential microphone (configuration (A)) and a plan view of differential microphone 110A according to the present embodiment (configuration (B)). As shown in FIG. 11, first opening 612A and second opening 612B in upper housing 612 of differential microphone 110A according to the present embodiment are shorter in the direction of the straight line connecting both first opening 612A and second opening 612B. Therefore, differential microphone 110A according to the present embodiment is more compact than the conventional differential microphone.

Second Embodiment

Next, a second embodiment of the present invention will be described. Sound signal transmitting and receiving device 100A according to the above first embodiment had differential microphone 110A including one diaphragm 113A. On the other hand, a sound signal transmitting and receiving device 100B according to the present embodiment has a differential microphone 110B including two diaphragms 113B and 113C.

<Overall Configuration of Sound Signal Transmitting and Receiving Device 100B>

Figure 12:
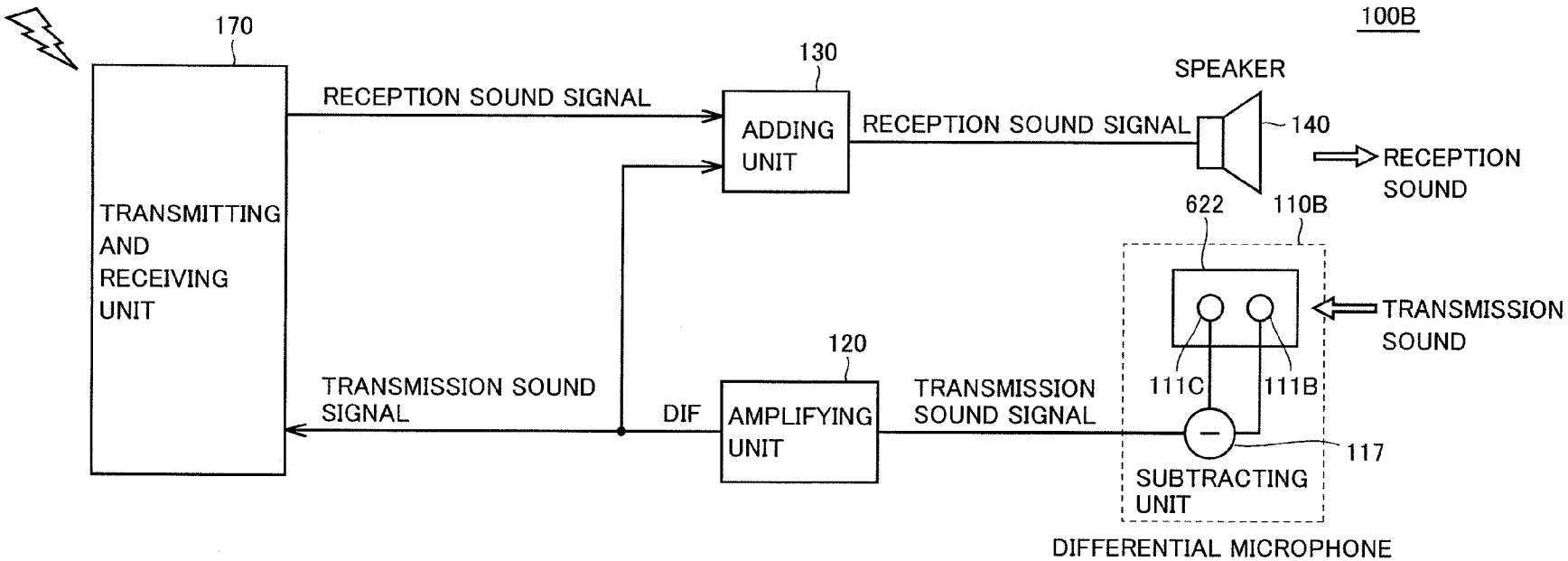
FIG. 12 is a block diagram showing an overall configuration of a sound signal transmitting and receiving device according to a second embodiment.

FIG. 12 is a block diagram showing an overall configuration of sound signal transmitting and receiving device 100B according to the present embodiment. As shown in FIG. 12, sound signal transmitting and receiving device 100B according to the present embodiment includes differential microphone 110B, amplifying unit 120, adding unit 130, speaker 140, and transmitting and receiving unit 170. Differential microphone 110B according to the present embodiment includes a first vibration sensing unit 111B, a second vibration sensing unit 111C and a subtracting unit 117.

Figure 13:
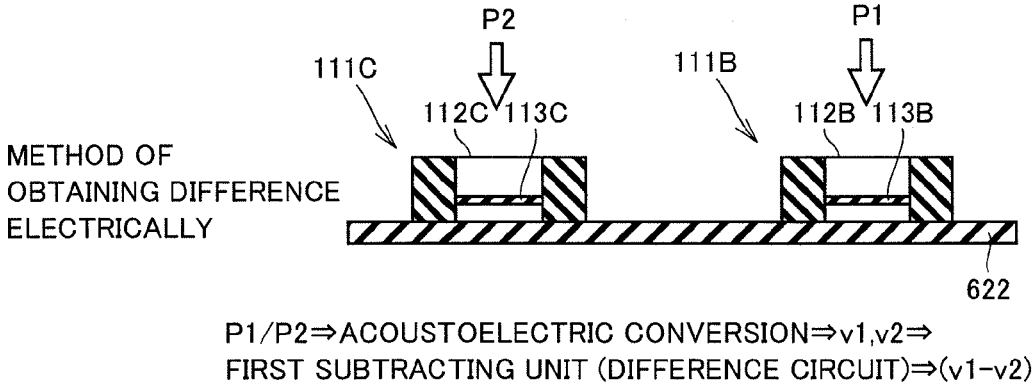
FIG. 13 is a front cross-sectional view showing a first vibration sensing unit and a second vibration sensing unit.

FIG. 13 is a front cross-sectional view showing first vibration sensing unit 111B and second vibration sensing unit 111C. As shown in FIGS. 12 and 13, differential microphone 110A includes first vibration sensing unit 111B and second vibration sensing unit 111C. First vibration sensing unit 111B includes first diaphragm 113B. Second vibration sensing unit 111B includes second diaphragm 113C.

First diaphragm 113B vibrates in accordance with a sound pressure P1 of the sound wave reaching first diaphragm 113B, and first vibration sensing unit 111B generates a first electric signal corresponding to this vibration. Second diaphragm 113C vibrates in accordance with a sound pressure P2 of the sound wave reaching second diaphragm 113C, and second vibration sensing unit 111C generates a second electric signal corresponding to this vibration.

First vibration sensing unit 111B and second vibration sensing unit 111C are connected to subtracting unit 117. Subtracting unit 117 is implemented by, for example, ASIC 240 and the like described in the first embodiment. Based on the first electric signal input from first vibration sensing unit 111B and the second electric signal input from second vibration sensing unit 111C, subtracting unit 117 generates a difference signal between the first electric signal and the second electric signal as the transmission sound signal.

The remaining configuration of sound signal transmitting and receiving device 100B is similar to the configuration in the above first embodiment, and thus, detailed description will not be repeated. In addition, the principle of noise removal is also similar to the principle of noise removal in the above first embodiment, and thus, detailed description will not be repeated here.

<Configuration of Differential Microphone 110B>

Figure 14:
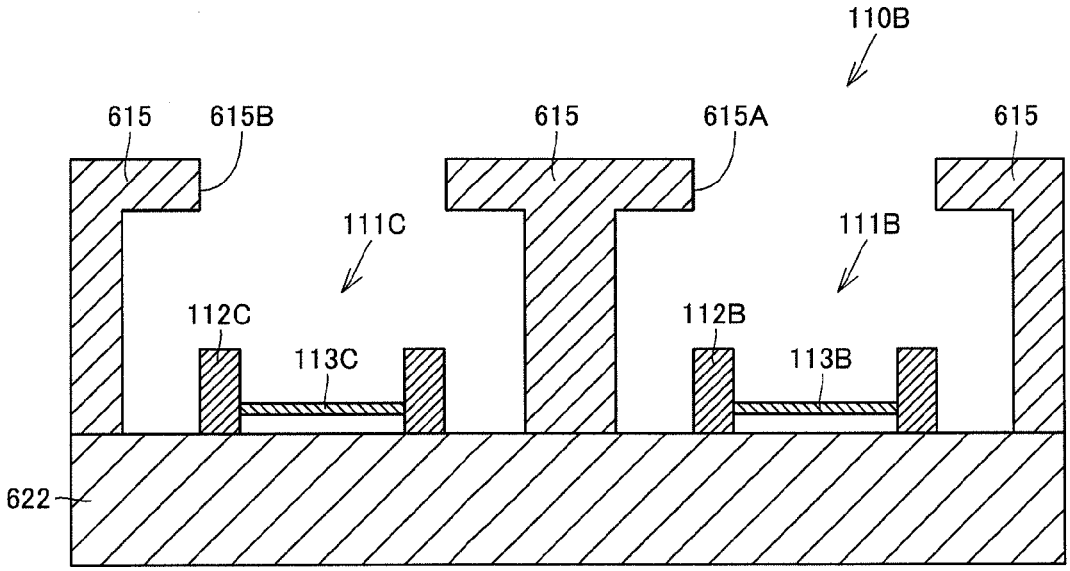
FIG. 14 is a front cross-sectional view of a differential microphone according to the second embodiment.

Next, a configuration of differential microphone 110B according to the present embodiment will be described. FIG. 14 is a front cross-sectional view of differential microphone 110B according to the present embodiment.

As shown in FIG. 14, differential microphone 110B includes a second substrate 622 and an upper housing 615 stacked on second substrate 622. First diaphragm 113B, second diaphragm 113C and the not-shown ASIC are arranged on an upper surface of second substrate 622. Between upper housing 615 and second substrate 622, upper housing 615 includes a first space for surrounding first diaphragm 113B and a second space for surrounding second diaphragm 113C.

A first opening 615A for transmitting the sound vibration from outside differential microphone 110A to the first space is formed at one end of upper housing 615. The sound vibration travels through first opening 615A to an upper surface of first diaphragm 113B.

In addition, a second opening 615B for transmitting the sound vibration from outside differential microphone 110A to the second space is formed at the other end of upper housing 615. The sound vibration travels through second opening 615B to an upper surface of second diaphragm 113B.

Since differential microphone 110A according to the present embodiment is configured as described above, the sound wave transmitted to first diaphragm 113B and the sound wave transmitted to second diaphragm 113C, of the sound wave from the sound source located on a straight line connecting first opening 615A and second opening 615B, are different from each other in terms of the transmission distance from the sound source. In other words, the sound wave (sound pressure P1) transmitted through first opening 615A to first diaphragm 113B and the sound wave (sound pressure P2) transmitted through second opening 615B to second diaphragm 113C, of the sound wave propagated from the position on the straight line connecting first opening 615A and second opening 615B, are different from each other in terms of the transmission distance.

In addition, differential microphone 110B according to the present embodiment may be configured such that a sound wave arrival time from first opening 615A to first diaphragm 113B is equal to a sound wave arrival time from second opening 615B to second diaphragm 113C. In order to make the sound wave arrival times equal, differential microphone 110B according to the present embodiment may be configured, for example, such that a path length of the sound wave from first opening 615A to first diaphragm 113B is equal to a path length of the sound wave from second opening 615B to first diaphragm 113C. The path length may be, for example, a length of a line connecting a center in a cross section of the path. Preferably, by making the ratio of both path lengths equal in the range of ±20% and making acoustic impedances of both path lengths substantially equal, excellent characteristics of the differential microphone can be obtained especially in the high-frequency band.

As described above, the sound pressure attenuates sharply at the position close to the sound source (on the left side in the graph in FIG. 4), and attenuates gently at the position farther from the sound source (on the right side in the graph in FIG. 4). Therefore, as for the sound wave of the speech sound from the speaker, sound pressure P1 transmitted to first diaphragm 113B differs significantly from sound pressure P2 transmitted to second diaphragm 113C. On the other hand, as for the sound wave of the surrounding background noise, a difference between sound pressure P1 transmitted to first diaphragm 113B and sound pressure P2 transmitted to second diaphragm 113C is very small.

Since there is only a very small difference between sound pressure P1 of the background noise received at first diaphragm 113B and sound pressure P2 of the background noise received at second diaphragm 113C, the sound signals for the background noise substantially cancel each other out at subtracting unit 117. In contrast to this, since there is a large difference between sound pressure P1 of the speech sound from the speaker received at first diaphragm 113B and sound pressure P2 of the speech sound from the speaker received at second diaphragm 113C, the sound signals for the speech sound do not cancel each other out at subtracting unit 117. In such a manner, differential microphone 110B uses subtracting unit 117 to output, as the transmission sound signal, a sound signal obtained as a result of vibration of first and second diaphragms 113B and 113C.

The shape of first opening 615A and second opening 615B of upper housing 615 according to the present embodiment is similar to the shape in the first embodiment. In other words, a dimension of first opening 615A and second opening 615B in a direction (first direction) perpendicular to a straight line passing through the centers of first opening 615A and second opening 615B is longer than a dimension in a direction (second direction) of the straight line passing through the centers of first opening 615A and second opening 615B. In other words, the shape of first opening 615A and second opening 615B of upper housing 615 according to the present embodiment is also similar to the shape in the first embodiment shown in FIGS. 5A, 7 and 8, configuration (B) in FIG. 10 and configuration (B) in FIG. 11, and thus, detailed description will not be repeated here.

It should be understood that the embodiments disclosed herein are illustrative and not limitative in any respect. The scope of the present invention is defined by the terms of the claims, rather than the above description, and is intended to include any modifications within the scope and meaning equivalent to the terms of the claims.

DESCRIPTION OF THE REFERENCE SIGNS

100A, 100B sound signal transmitting and receiving device; 110A, 110B differential microphone; 111A, 111B, 111C vibration sensing unit; 113A, 113B, 113C diaphragm; 117 subtracting unit; 120 amplifying unit; 130 adding unit; 140 speaker; 170 transmitting and receiving unit; 600, 611, 612, 613, 615 upper housing; 600A, 611A, 612A, 613A, 615A first opening; 600B, 611B, 612B, 613B, 615B second opening; 621, 622 second substrate; 621A first substrate opening; 621B second substrate opening; 630 first substrate; 630A thin bottom portion

The invention claimed is:

1. A differential microphone unit, including a vibration sensing unit having a diaphragm, a stacked substrate on which said vibration sensing unit is mounted, and an upper housing covering said vibration sensing unit and put on one surface of said stacked substrate to form a first space, wherein:

said differential microphone unit has a first opening and a second opening provided in an identical surface of said upper housing;

a sound wave input from said first opening is transmitted to a front surface of said diaphragm through said first space, and a sound wave input from said second opening is transmitted to a rear surface of said diaphragm through a second space including an internal space of the stacked substrate;

said first opening and said second opening are line-symmetric with respect to an axis parallel to a second direction perpendicular to a first direction in which said first opening and said second opening are arranged in said upper housing;

a dimension of a width of said first opening and said second opening in a portion parallel to the second direction is longer than a dimension of a width of said first opening and said second opening in a portion parallel to said first direction;

a dimension of a width of said second space formed in said upper housing in a portion parallel to said second direction is longer than the dimension of the width of said first opening and said second opening in the portion parallel to said first direction; and the dimension of the width of said first opening and said second opening in the portion parallel to said second direction is substantially equal to the dimension of the width of said second space formed in said upper housing in the portion parallel to said second direction.

2. The differential microphone according to claim 1, wherein the internal space of said stacked substrate includes an internal layer space extending in a direction horizontal to a surface of said stacked substrate inside said stacked substrate, and a dimension of a width of said internal layer space in a portion parallel to said second direction is longer than a dimension of said stacked substrate in a thickness direction.

3. The differential microphone according to claim 2, wherein the dimension of the width of said internal layer space in the portion parallel to said second direction is substantially equal to the dimension of the width of said second space formed in said upper housing in the portion parallel to said second direction.

4. The differential microphone according to claim 3, wherein a distance from said first opening to said diaphragm is equal to a distance from said second opening to said diaphragm.

5. The differential microphone according to claim 1, wherein a distance from said first opening to said diaphragm is equal to a distance from said second opening to said diaphragm.

6. The differential microphone according to claim 2, wherein a distance from said first opening to said diaphragm is equal to a distance from said second opening to said diaphragm.

7. The differential microphone according to claim 1, wherein said first opening and said second opening have an oval shape whose longer axis corresponds to the first direction.

8. The differential microphone according to claim 1, wherein said first opening and said second opening have an identical shape.

* * * * *